US012765676B2

(12) United States Patent
Kapij et al.

(10) Patent No.: US 12,765,676 B2
(45) Date of Patent: Oct. 20, 2026

(54) LOCKING MECHANISM FOR AN INTELLIGENT AUTOMATED CHAIR

(71) Applicant: Movably, Inc., Lexington, MA (US)

(72) Inventors: Mark Kapij, Lexington, MA (US); Jose Chavarria, Lexington, MA (US); Lorenz Klauser, Lexington, MA (US); Stefan Stalder, Lexington, MA (US)

(73) Assignee: Movably, Inc., Lexington, MA (US)

( * ) Notice: Subject to any disclaimer, the term of this patent is extended or adjusted under 35 U.S.C. 154(b) by 391 days.

(21) Appl. No.: 18/503,614

(22) Filed: Nov. 7, 2023

(65) Prior Publication Data

US 2024/0148149 A1 May 9, 2024

Related U.S. Application Data

(60) Provisional application No. 63/423,535, filed on Nov. 8, 2022.

(51) Int. Cl.
*A47C 7/14* (2006.01)
*A47C 3/18* (2006.01)

(52) U.S. Cl.
CPC ..... *A47C 7/144* (2018.08); *A47C 3/18* (2013.01)

(58) Field of Classification Search
CPC ..... A47C 7/144; A47C 3/18
USPC ..... 297/312, 313
See application file for complete search history.

(56) References Cited

U.S. PATENT DOCUMENTS

| | | | | |
|---|---|---|---|---|
| 4,085,969 | A | 4/1978 | Nakane | |
| 4,451,086 | A * | 5/1984 | Seven | A47C 7/024 297/312 |
| 7,387,339 | B2 * | 6/2008 | Bykov | A47C 7/024 297/312 |
| 8,220,872 | B2 * | 7/2012 | Hong | A47C 7/024 297/312 X |
| 11,160,704 | B2 * | 11/2021 | Stajic | A61G 5/14 |
| 2003/0151288 | A1 | 8/2003 | Deisig | |
| 2012/0008625 | A1 | 1/2012 | Ulupinar et al. | |
| 2020/0315358 | A1 | 10/2020 | Lim et al. | |
| 2021/0386213 | A1 | 12/2021 | Kapij | |

* cited by examiner

*Primary Examiner* — Anthony D Barfield
(74) *Attorney, Agent, or Firm* — Lambert Shortell & Connaughton; David J. Connaughton, Jr.; Justin P. Tinger

(57) ABSTRACT

A locking mechanism for a smart automated chair is provided. The chair is operable to move a seat between a horizontal seating position and a vertical downward standing position. When moving to the horizontal seating position, in some instances a user may sit on the seat before it has reached a locked horizontal position, this can increase a risk of the seat slipping or otherwise releasing to a downward vertical position, causing risk of inconvenience to a user, the locking mechanism herein addresses this issue.

20 Claims, 15 Drawing Sheets

600

LOCKING MECHANISM FOR AN INTELLIGENT AUTOMATED CHAIR

TECHNICAL FIELD

The present disclosure generally relates to a locking mechanism for use with intelligent automated chairs configured to help users transition between various posture changes during use.

BACKGROUND

The conventional office desk chair, designed primarily for seated positions, has remained largely unchanged for decades. While many contemporary office chairs offer limited manual adjustments to enhance user comfort, they do not address the need for dynamic and automated posture transitions that are essential for maintaining optimal musculoskeletal health, especially in today's increasingly sedentary work environments.

Numerous studies have highlighted the detrimental effects of prolonged sitting on physical health, including musculoskeletal disorders, cardiovascular problems, and reduced productivity. To combat these issues, various ergonomic chairs and sit-stand desks have been introduced to the market. However, these solutions often require manual adjustments or the use of additional furniture, making them inconvenient and less intuitive for users to adopt consistently.

Existing attempts to create adaptable office seating solutions often lack the sophistication needed to seamlessly transition between sitting and standing positions. These designs frequently rely on complex mechanical systems that are costly, prone to wear and tear, and subject to user discomfort due to abrupt or imprecise position changes.

Intelligent automated chairs, such as the one described in U.S. application Ser. No. 17/338,631 enable users to transition seamlessly between various posture positions without disrupting the natural workflow of a user's workstation. These changes in posture help increase blood flow and provide an improved health benefit to the user.

As these intelligent automated chairs are being developed and utilized areas for improvement are being discovered. This application seeks to improve upon one such aspect related to the chair leaf transitioning between lower to an upper position.

SUMMARY OF THE INVENTION

Described herein is an embodiment of a locking mechanism for use with an intelligent automated chair, wherein the intelligent automated chair includes: a base portion, a vertical support extending from the base portion, a horizontal support interfacing with the vertical support, a right leaf extending from the horizontal support and configured to be driven by a right motor that causes the right leaf to alter between positions of horizontal and vertical, a left leaf extending from the horizontal support and configured to be driven by a left motor that causes the left leaf to alter between positions of horizontal and vertical, and an automated control assembly electrically coupled to the right motor and the left motor, and configured to operate according to an automated shifting pattern that causes the right leaf and left leaf to change positions, wherein each position change is associated with a posture change, and wherein the automated control assembly is also configured to receive user input that can modify the automated shifting pattern, and where the locking mechanism is comprised of: a releasable locking component that is configured to allow a plurality of ridges, each formed within an inner portion of a leaf perch that is attached to the right or left leaf perch, to pass thereby along a first direction of rotation, and whereupon a force that is counter to the first direction of rotation causes a pawl or other similar blocking structure such as a block to engage with one of the plurality of ridges and prevents rotation that is counter to the first direction of rotation.

Also described herein is another embodiment of a locking mechanism for use with an intelligent automated chair, wherein the intelligent automated chair includes: a base portion, a vertical support extending from the base portion, a horizontal support interfacing with the vertical support, a right leaf extending from the horizontal support and configured to be driven by a right motor that causes the right leaf to alter between positions of horizontal and vertical, a left leaf extending from the horizontal support and configured to be driven by a left motor that causes the left leaf to alter between positions of horizontal and vertical, and an automated control assembly electrically coupled to the right motor and the left motor, and configured to operate according to an automated shifting pattern that causes the right leaf and left leaf to change positions, wherein each position change is associated with a posture change, and wherein the automated control assembly is also configured to receive user input that can modify the automated shifting pattern, and where the locking mechanism is comprised of: a releasable locking component comprised of a plurality of arms, wherein each arm has an offset ledge disposed on an underneath portion of each arm, and wherein each offset ledge is configured to initially engage with a plurality of slots, each slot formed within an inner portion of a leaf perch that is attached to the right or left leaf perch, as the leaf perch is rotated past a first engagement angle, and wherein the remaining portion of each is configured to engage with the slot as the leaf perch is rotated to a second engagement angle.

In the second embodiment a spring can be used to drive the locking mechanism into the slots as the leaf perch is rotated.

BRIEF DESCRIPTION OF THE DRAWINGS

The foregoing and other objects, features, and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention, wherein.

DETAILED DESCRIPTION OF THE INVENTION

Figure 1B:
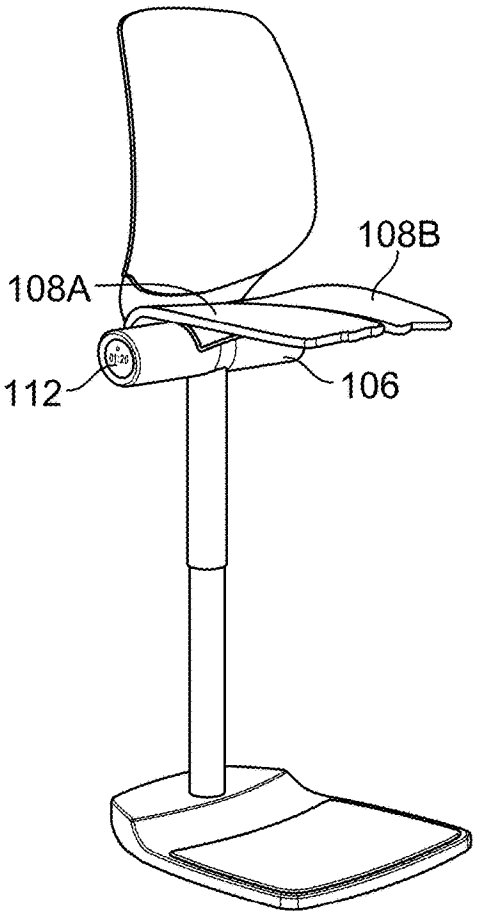
FIG. 1B illustrates a view of an embodiment of an intelligent automated chair.

As noted in the background one of the problems that intelligent automated chairs are seeking to address is to minimize disrupting a person's work, while introducing an optimal amount of activity in the person, through various posture changes, to provide health benefits. Some of the health benefits for example can include slightly increasing the heart rate with some motion, which can allow the spinal disks to get nutrition via diffusion. By shifting positions periodically muscle fatigue and strain on various parts of the body are reduced. A slight increase in blood flow can also help with increasing oxygen to the brain, which can help with focus and concentration, which is often needed when performing various tasks at a desk, such as coding, legal work, accounting, engineering work, and so forth.

The present invention relates to an intelligent automated chair designed to promote optimal posture and user comfort during extended periods of working. The chair incorporates a unique combination of mechanical components and advanced automation technology to facilitate dynamic changes in posture and position. Further, the chair has a locking mechanism for the seat that provides an important safety feature when the chair moves from a seated mode to a standing mode.

The intelligent automated chair comprises a sturdy and stable base portion that serves as its foundation. The base portion is typically constructed from durable materials such as metal or reinforced polymers, ensuring long-term stability and support. The base portion may extend forwardly, rearwardly, and to the side of the chair to form a safe stable base for the chair to prevent tipping.

Extending vertically from the base portion is a vertical support. This vertical support provides the chair with the necessary height and structural integrity. It also may house components of the chair's automation system, including power distribution and control circuitry.

A horizontal support is connected to a top of the vertical support. In one embodiment, this horizontal support is seamlessly interfaces with the vertical support, though may be connected via more traditional connections such as a weld, bolt/screw, and the like, and any connection of the two may be achieved without straying from the scope of this invention. The horizontal support extends horizontally and acts as the primary connection point for the chair's seating components, facilitating the transition between sitting and standing postures.

In many embodiments, the intelligent automated chair seat has right leaf and left leaf. These leaf-like components are attached to the horizontal support via hinges, allowing them to alter between positions of horizontal and vertical which correspond to a seating mode and a standing mode, respectively. As generally discussed herein, the locking mechanism is described with respect to the two-leaf seat embodiment. However, a locking mechanism, such as those described herein, may also be used in a single seat automated chair which allows the single seat to move between horizontal and vertical positions without straying from the scope of this invention.

Each leaf of the seat is individually configured with a motor. In a two leaf embodiment, a control system actuates movement of the leaves using a right motor and a left motor, which enable the automated transition between horizontal and vertical positions. These motors are controlled by the automated control system assembly, as described in greater detail below.

The intelligent automated chair is equipped with an automated control assembly that controls the chair's configuration. In one embodiment, the control assembly may be programmed to operate the chair according to a predefined automated shifting pattern, which dictates the sequence and timing of position changes for the right and left leaves. Examples of this programming is discussed further below.

The automated shifting pattern is designed to encourage dynamic changes in posture, thereby reducing the negative effects of prolonged sitting. For example, the chair may transition from a sitting position to a standing position at regular intervals to alleviate the physical strain associated with extended sitting. The pattern can be customized to accommodate user preferences and specific ergonomic requirements. In other embodiments, the user may have full control over timing and orientation of the chair using the control assembly input(s).

In addition to the automated shifting pattern, the intelligent automated chair allows users to provide input that can modify the chair's behavior. An intuitive user interface, typically integrated into the chair's armrest or another accessible location, enables users to make real-time adjustments to the chair's posture transitions. Users can select different patterns, change the timing of transitions, or override the automated pattern entirely.

In one embodiment, the automated chair may operate to change its positions as follows. The automated control assembly may receive user input and follows a predefined automated shifting pattern. In response to the input and pattern, the right motor and left motor drive the right and left leaves to change positions between horizontal and vertical, respectively. Each position change is associated with a distinct posture change, such as described below, promoting musculoskeletal health and user comfort.

The intelligent automated chair of the present disclosure offers numerous benefits, including: Reduced risk of musculoskeletal disorders associated with prolonged sitting, improved posture and comfort during extended periods of seating, enhanced user well-being and productivity, and customizable automation patterns to suit individual user preferences. These advantages are further improved by the locking mechanism disclosed herein which prevents the seat or seat leaf from slipping to a vertical position during a movement due to weight being applied to the seat by the user.

The locking mechanism disclosed here functions to lock the seat leaf or leaves in place when in their transitory state, i.e. between, but not in, the vertical position for standing and the horizontal position for sitting. As noted below, if a user sits or applies too much weight or force to the leaf while it is in the transitory state, moving between the vertical and horizontal positions, the leaves may give way and fall to the vertical position, causing a user to fall, slip or be otherwise disrupted, leading to potential injury, discomfort, and losing interest in the use of the chair. The motor and/or gearbox may also be damaged during such an action leading to a broken device and reduced product life. The locking mechanism operates by catching or otherwise preventing the leaf from releasing to the vertical position at a rate faster than that intended by the actuating motor. In many embodiments, the activation of the locking mechanism will actuate a "recover" motion of the motor and cause the motor to return to a vertical or horizontal position, re-set and then re-attempt the movement. The locking mechanism generally may be any structure capable of functioning as discussed herein, and structural examples are provided below.

Figure 1A:
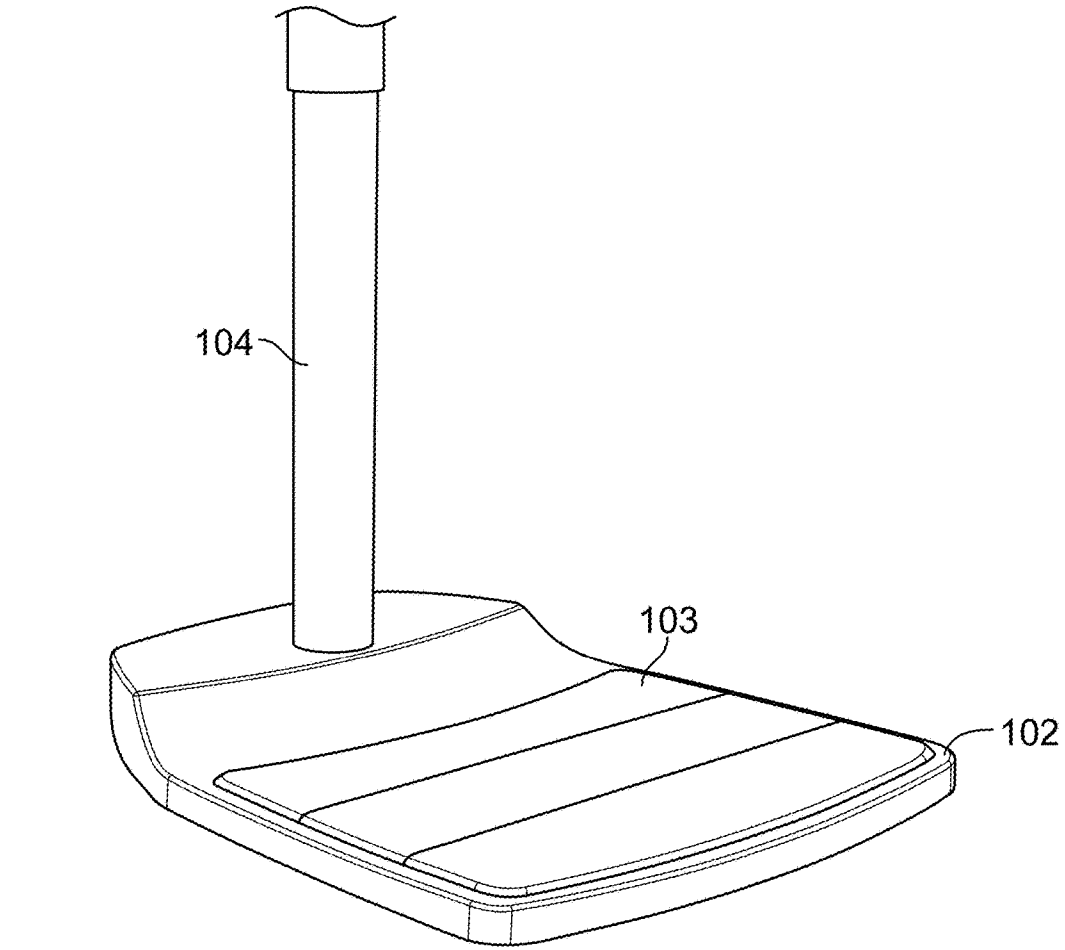
FIG. 1A illustrates a view of an embodiment of an intelligent automated chair.

Turning now to the figures, FIGS. 1A-B illustrate embodiment of an intelligent automated chair 100, which includes a base 102, attached to a vertical support 104. Base 102 has a textured surface 103 configured to have a layer of cushion and support when a user is in the standing position. The textured surface 103 is also configured to be a non-slip surface in certain embodiments. 100 also includes a control interface 112 on horizontal support 106, which is connected to right leaf 108A and left leaf 108B. In preferred embodiments, these leaves 108A, 108B are independently movable.

Figure 2A:
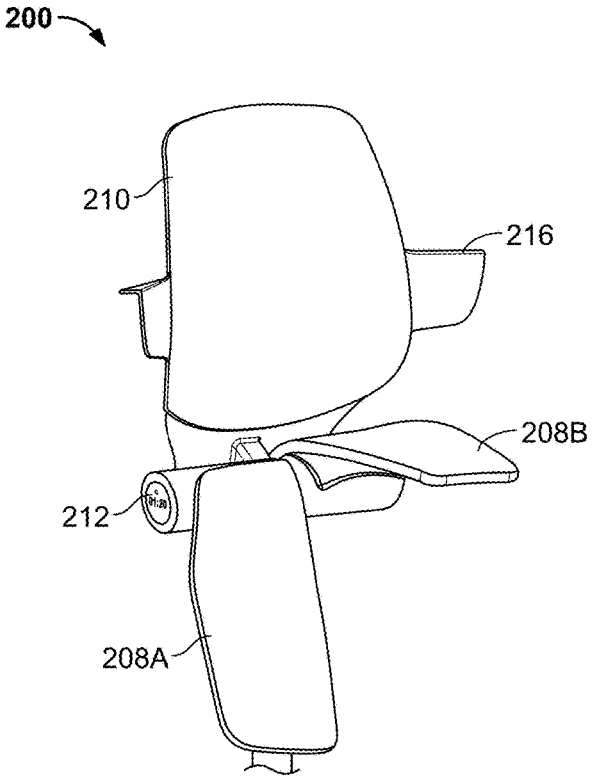
FIG. 2A illustrates a view of an embodiment of an intelligent automated chair with arm rests where the leaves of the chair are in varying positions.
Figure 2B:
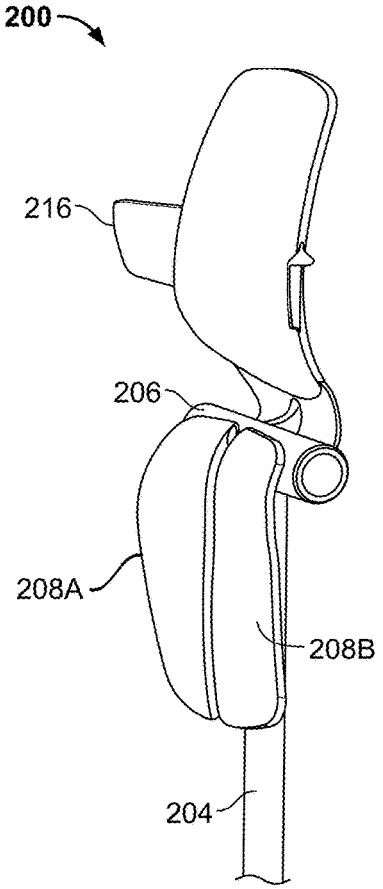
FIG. 2B illustrates a view of an embodiment of an intelligent automated chair with arm rests where the leaves of the chair are in varying positions.

FIGS. 2A-B illustrate another embodiment of an intelligent automated chair 200, illustrating version that includes armrests 216 that extend from the backrest 210. FIG. 2A illustrates how the motor and control systems disposed at least partially in the horizontal support 206 can lower right leaf 208A, while maintaining a horizontal position to left leaf 208B. In FIG. 2B, both right and leaf 208A, 208B are lowered to be vertically aligned with the vertical support 204. As discussed herein, the term "vertical position" is described with respect to a front of the seat pointing downward and a top of the seat being vertical. However, in other embodiments, the top of the seat may point upward with a top of the seat being vertical without straying from the scope of this disclosure. These different configuration positions of the seat portion, which is comprised of right and left leaf 208A, 208B, can be controlled using at least control interface 212.

Figures 3A, 3B, 3C, 3D:
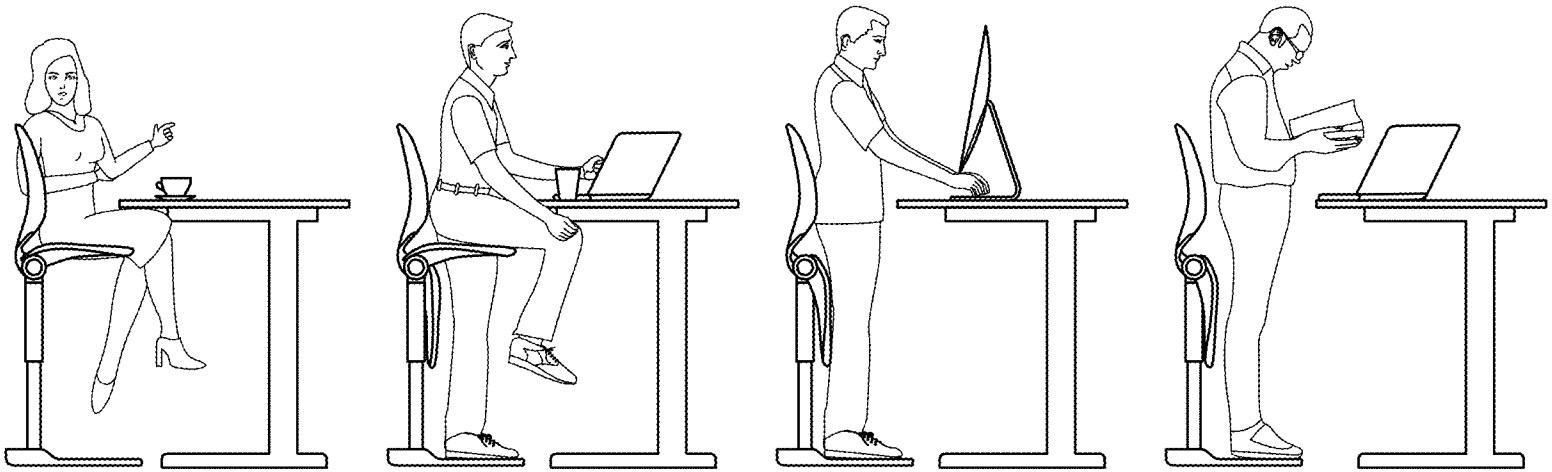
FIG. 3A illustrates a change in position of an intelligent automated chair and the various configurations or positions a user could utilize while using the intelligent automated chair.
FIG. 3B illustrates a change in position of an intelligent automated chair and the various configurations or positions a user could utilize while using the intelligent automated chair.
FIG. 3C illustrates a change in position of an intelligent automated chair and the various configurations or positions a user could utilize while using the intelligent automated chair.
FIG. 3D illustrates a change in position of an intelligent automated chair and the various configurations or positions a user could utilize while using the intelligent automated chair.

FIGS. 3A-D illustrate a change in position of an intelligent automated chair and the various configurations or positions a user could position themselves about the intelligent automated chair. For example, as shown in FIG. 3A, a user could be fully seated on the intelligent automated chair. In this fully sitting position both the right and left leaves are fixed in a horizontal position. After a period of time, the user can transition to a position shown in FIG. 3B where either the right or left leaf is lowered. In this position the user is standing on one leg (either the right or left leg) while resting the other leg or approximately half of the buttocks on the leaf of the seat that is in the horizontal position. The user can alternate standing on one leg while partially sitting from right side to left side. FIG. 3C illustrates another position the user can utilize the intelligent automated chair where the user is in a standing position, but still leaning their backside on the vertical portion of the intelligent automated chair. In FIG. 3D, the user is standing free of the chair on the base area, and not leaning on the intelligent automated chair at all. By switching between each of these positions the user can benefit from some of the health benefits noted above.

FIGS. 3A-D also illustrate that the intelligent automated chair can be used with a desk or table or type of workstation, which should be readily understood from reading this description. A workstation generally includes a chair, desk, computing device, monitor and other various office supplies.

Figure 4A:
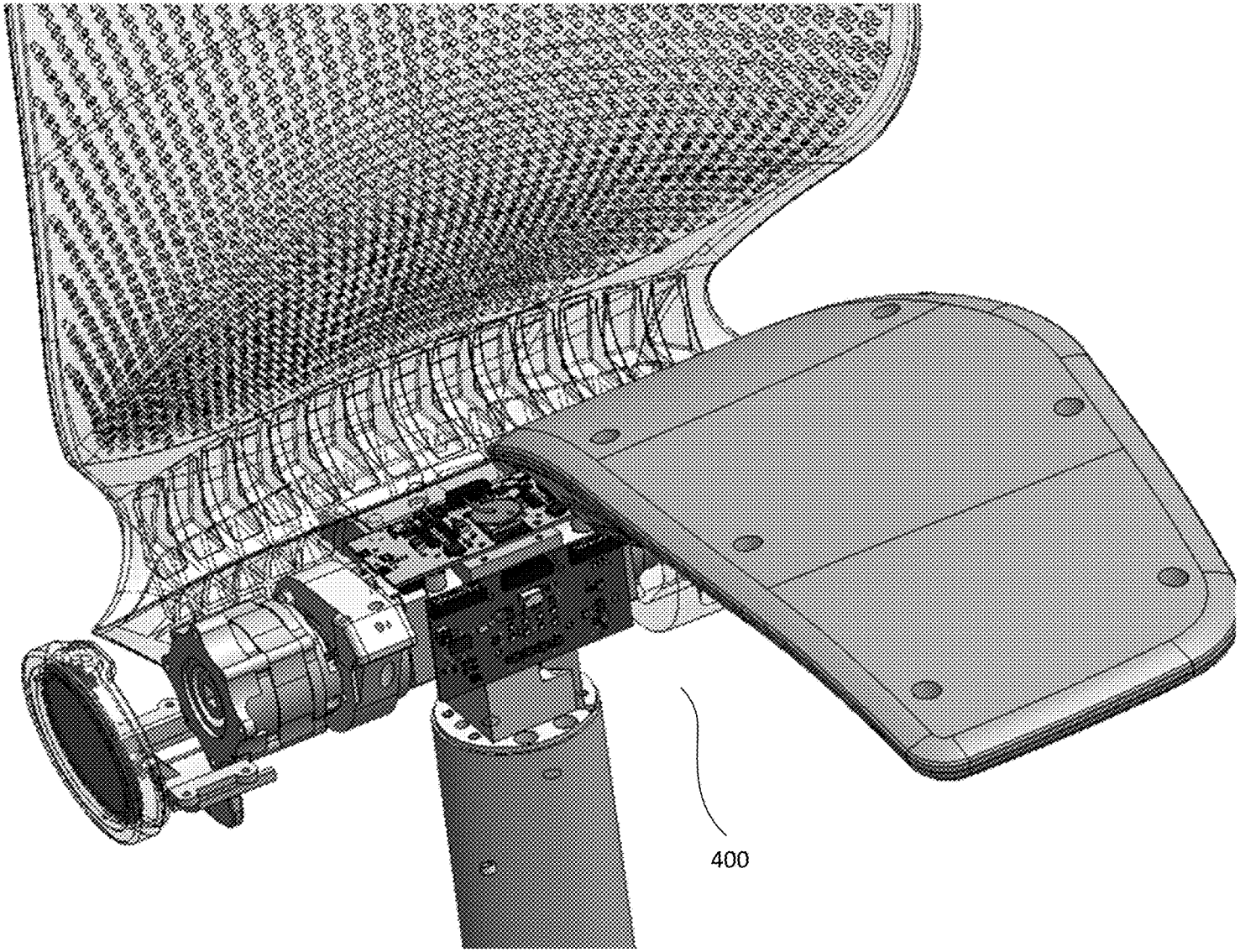
FIG. 4A illustrates various views of the automated control assembly used in the intelligent automated chairs.
Figure 4B:
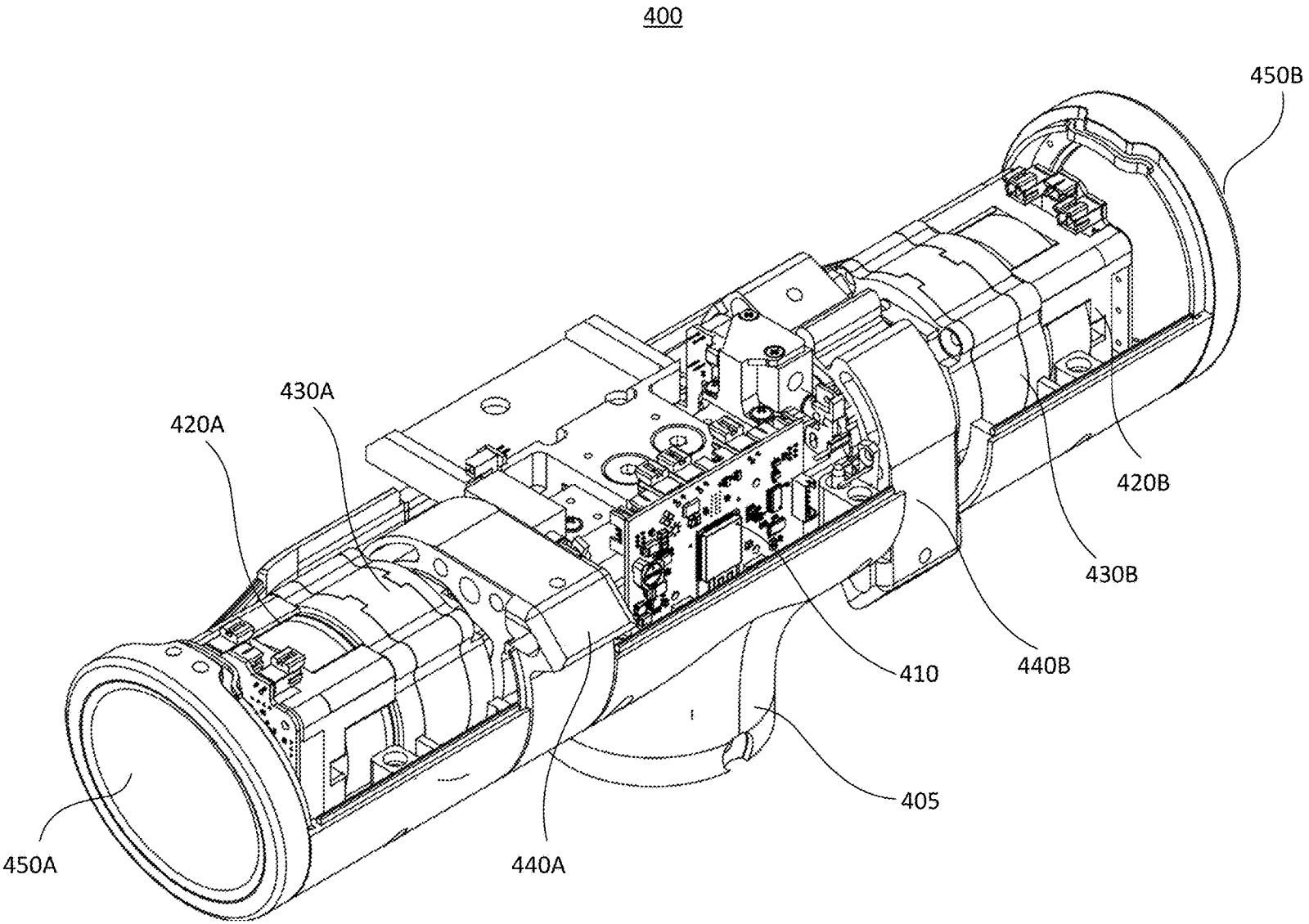
FIG. 4B illustrates various views of the automated control assembly used in the intelligent automated chairs.
Figure 4C:
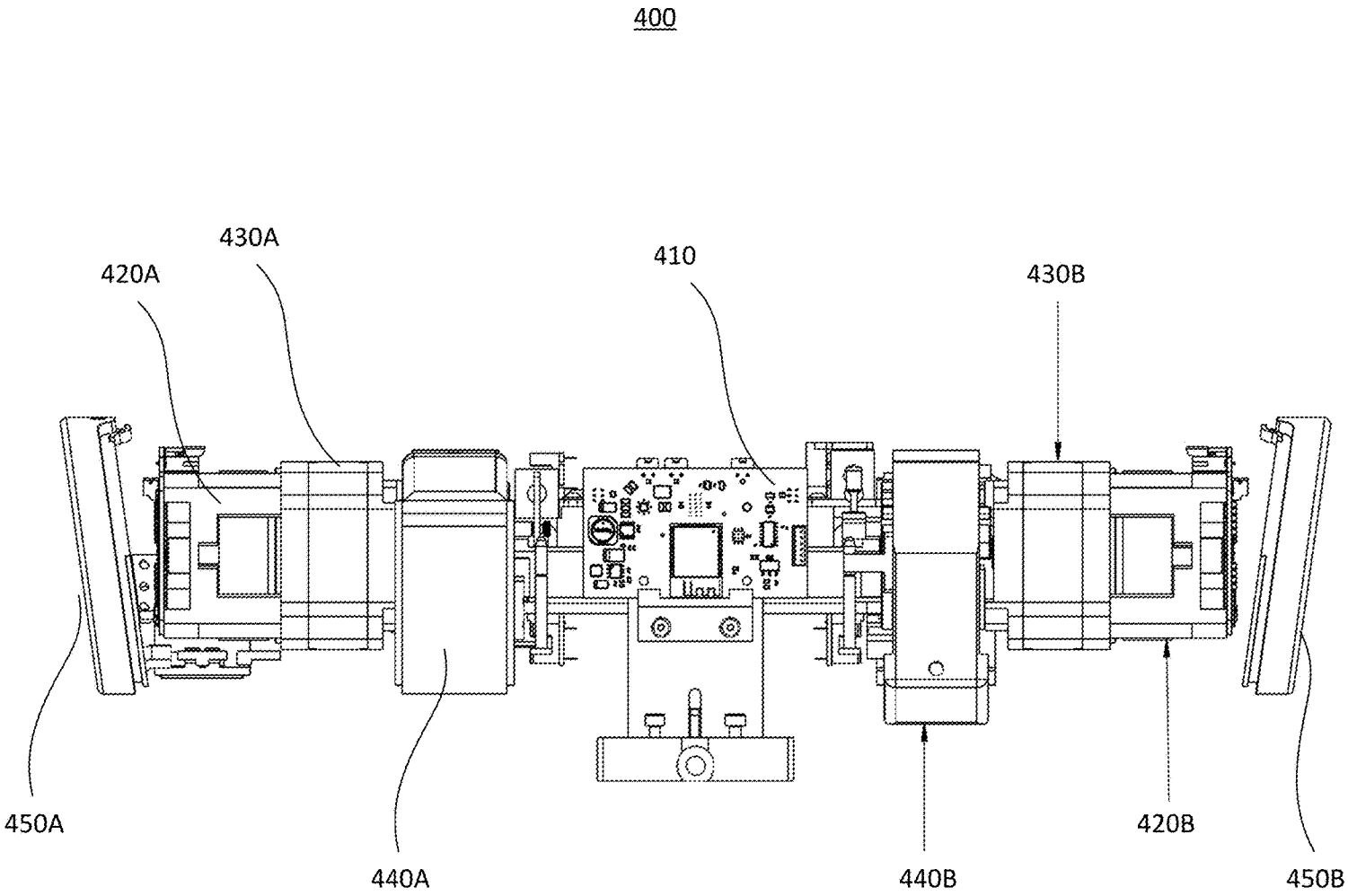
FIG. 4C illustrates various views of the automated control assembly used in the intelligent automated chairs.

FIGS. 4A-C illustrate various views of the automated control assembly 400 used in the intelligent automated chairs. FIG. 4A illustrates a partially cut-away view of the automated control assembly 400 that is housed and integrated with the horizontal supports noted above. The automated control assembly 400 as shown in FIGS. 4B-C have a control system 410 and two motors 420A, 420B. The motors 420A, 420B can be brushless DC motors. These can be connected to and operate gearboxes 430A, 430B, which in turn interface with output controllers or leaf perches 440A, 440B that connect to the right and left leaves of the seat such that a movement of the leaf perch 440A, 440B moves the corresponding seat leaf 208A, 208B attached thereto. An interface 450A, 450B are shown on the opposite ends of the assembly 400 and can utilized as an input interface for the assembly 400. A vertical support interface 405 is shown and configured to attach to the vertical supports previously described and shown.

The raising and lowering of the seat halves (right leaf/left leaf) are controlled and powered using the control system 410. The control system 410 can include one or more processors, memory, logic, power supply, sensors, wireless communication means, such as antennae configured to transmit and receive Bluetooth and WIFI protocols and signals. The control system 410 can further receive instructions on how to operate the controls leading to the changing of chair configurations, as shown in FIGS. 3A-D. For example, a set of operating mode instructions can be received wirelessly by the control system 410 and stored in an executable format in memory or logic to operate according to those operating mode instructions. As will be discussed in more detail below, the control system can also receive real-time feedback from the interfaces 450A and 450B, from one or more sensors, or interference when a change of position occurs to alter, at least temporarily, the current operating mode. This real-time feedback and input can also be used to update the current operating mode. The updating the pattern and operating mode calculation can either be performed in the control system, sent to a mobile computing device (or even the cloud) to be updated and then overriding or updating the instructions associated with the original operating mode. The control system 410 can also store usage information for later offloading and analysis in the cloud. This usage data can be part of a historical information database that include individual and/or group historical information, which is used to train and update recommended operating modes to users. It should be noted the operating modes determine the frequency of position of changes, the pattern of the position changes, the duration (e.g., 30 seconds standing, 1 minute fully sitting, 45 seconds right leg standing, 30 seconds left leg standing) of each position, the type or style of change notifications, default position when interrupted, and so forth.

One of the improvements to intelligent automated chairs the present embodiments seek to provide is that of an improved locking mechanism when one or both leaves of the chair are in a transitory state. This provides an important safety feature during operation and makes the changes in seat configuration potentially less frustrating and disruptive for a user. As shown in FIGS. 3A-D and described above, when the user is standing either on one leg or both legs, the right or left leaf can begin to raise, which gently bumps into the back of a user's leg indicating a transition from that particular leg standing to perching. If the leaf has not fully transitioned to a 90 degree angle before the user applies a force (sitting on the leaf) then the leaf, in a not fully engaged state, can fall and cause the user to potentially slip, fall over, and the like. Thus, an improved locking system has been developed that helps resolve the problem of early sitting to prevent slipping.

Figure 5A:
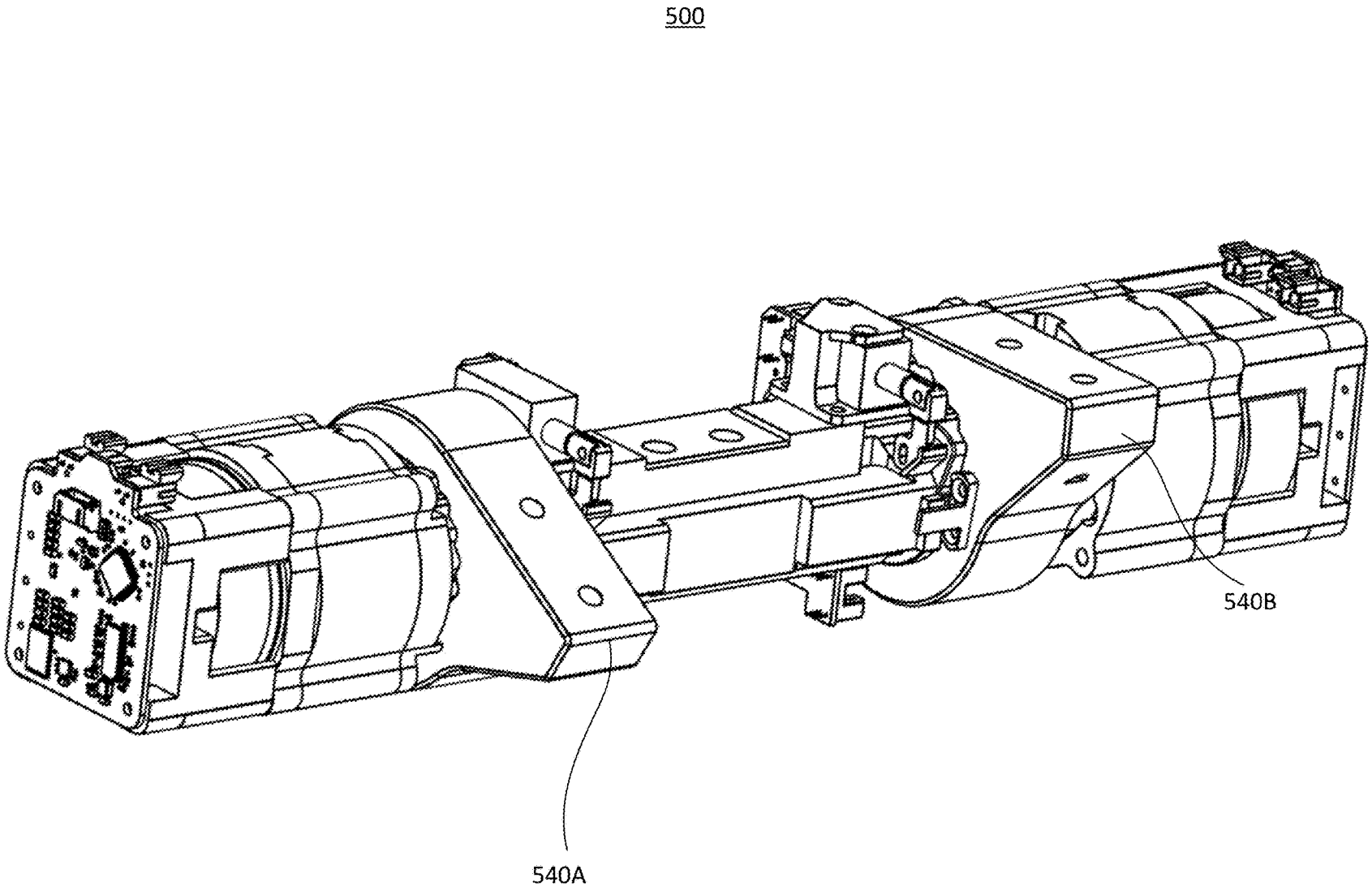
FIG. 5A illustrates a locking mechanism with variable locking states or positions.
Figure 5B:
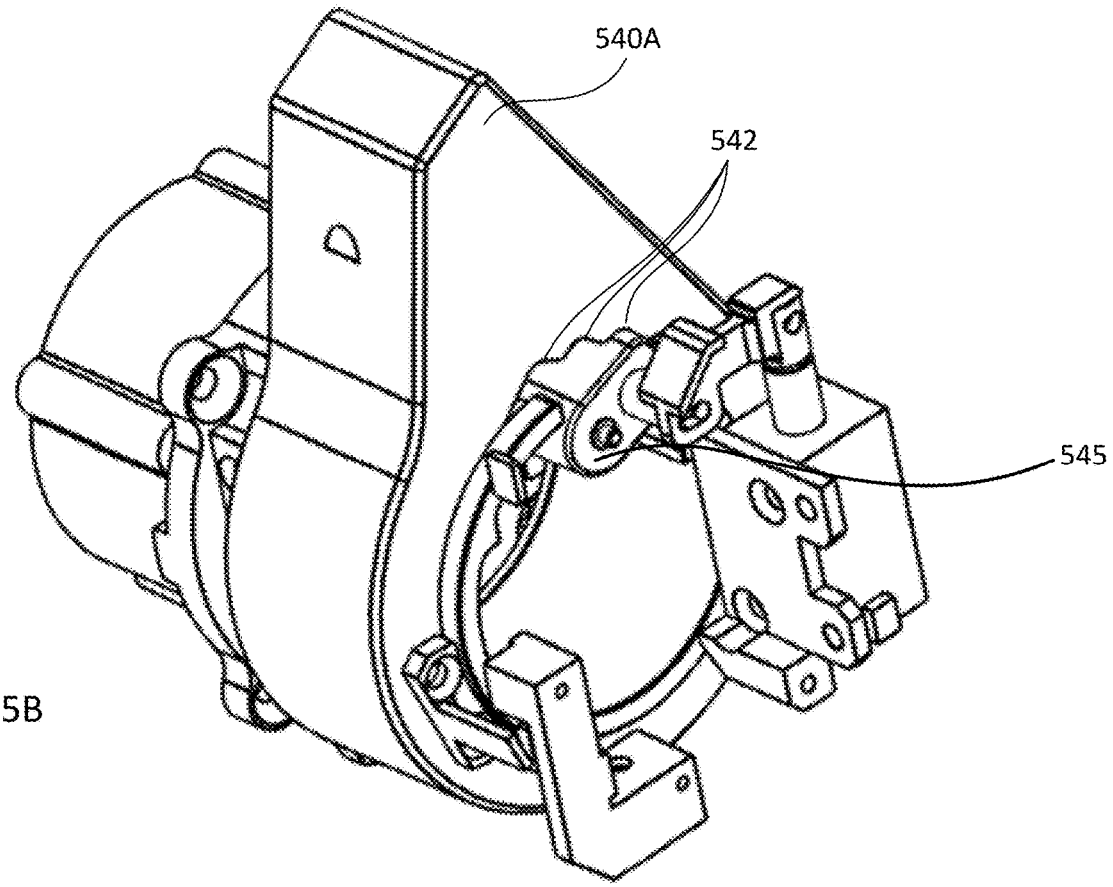
FIG. 5B illustrates a locking mechanism with variable locking states or positions.
Figure 5C:
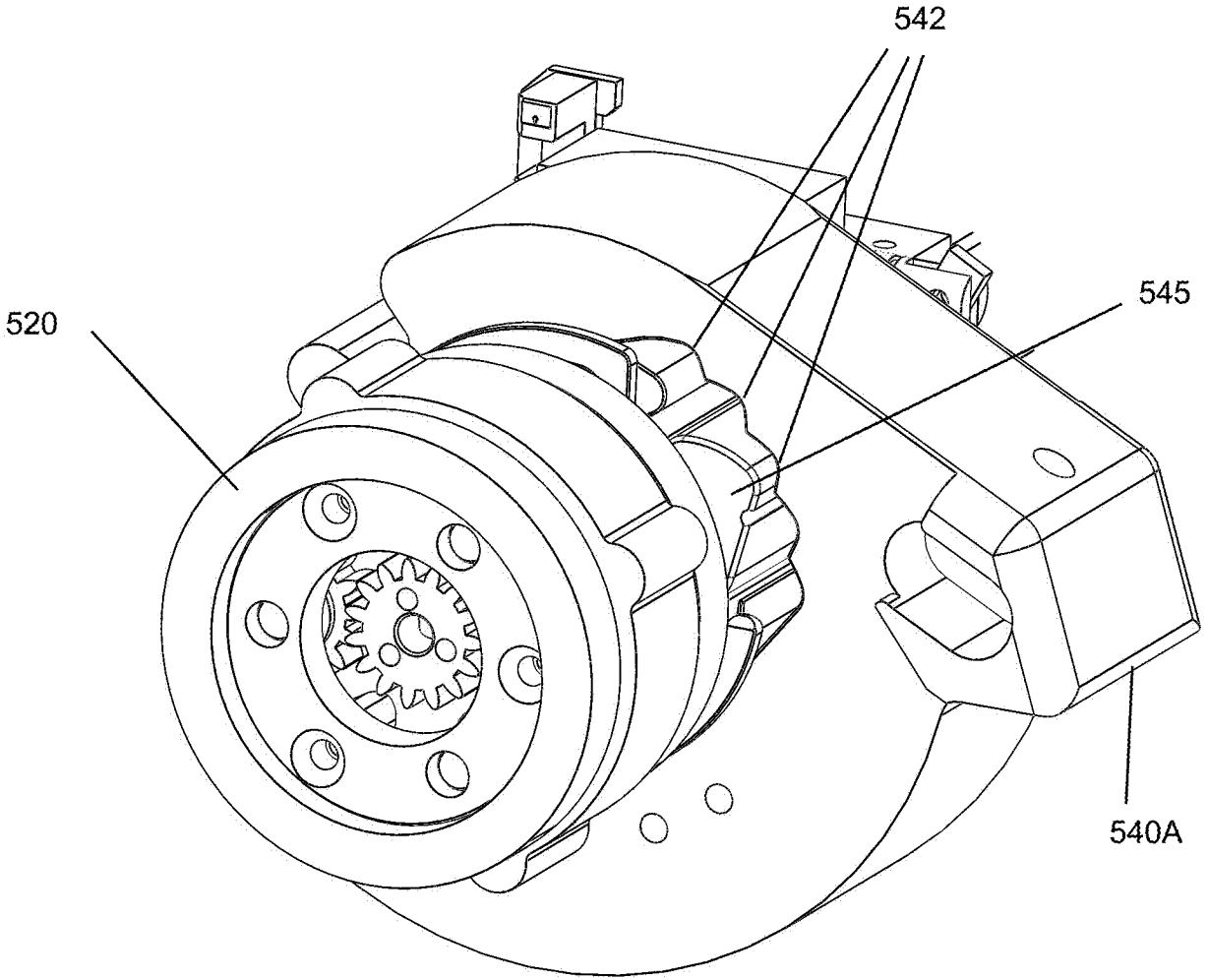
FIG. 5C illustrates a locking mechanism with variable locking states or positions.

FIGS. 5A-D illustrate a locking mechanism with variable locking states or positions that is part of the control assembly 500. Similar to control assembly 400, control assembly 500 also includes a pair of independently operated output controllers or leaf perches 540A, 540B that connect to the right and left leaves of the seat. As shown, in FIG. 5A, the leaf perch 540A is offset from the 90 degree angle of leaf perch 540B. FIGS. 5B-C illustrate various isolated views of leaf perch 540A and components interacting therewith to create a variable locking mechanism. For example, locking component 545, shown here as a type of pawl, interfaces with various notches 542 formed on an inner portion of the body of the leaf perch 540A. This ratchet-type interface allows the leaf perch to be raised up, as each of the notches or ridges push past 545, which functions as a one-way mechanism. However, the moment pressure is applied leaf perch 540A locking component 545 engages the current ridge or notch 542. The shape of the locking component pawl 545 ensures that the leaf perch 540A can move in an upward direction towards a horizontal position, but cannot rapidly and uncontrollably move to the vertical position due to an interference between pawl 545 and notch 542. A releasing mechanism can enable 545 to disengage when the leaf perch is to be rotated downward for a standing position. A transparent gear box 520 is shown in FIG. 5C that engages with leaf perch to raise and lower the leaf perch, which is driven by a motor assembly not shown in this figure. Of course, other similar structures which are able to allow motion in a first direction and stop motion in a second opposite direction may also be used without straying from the scope of this disclosure.

Figure 5D:
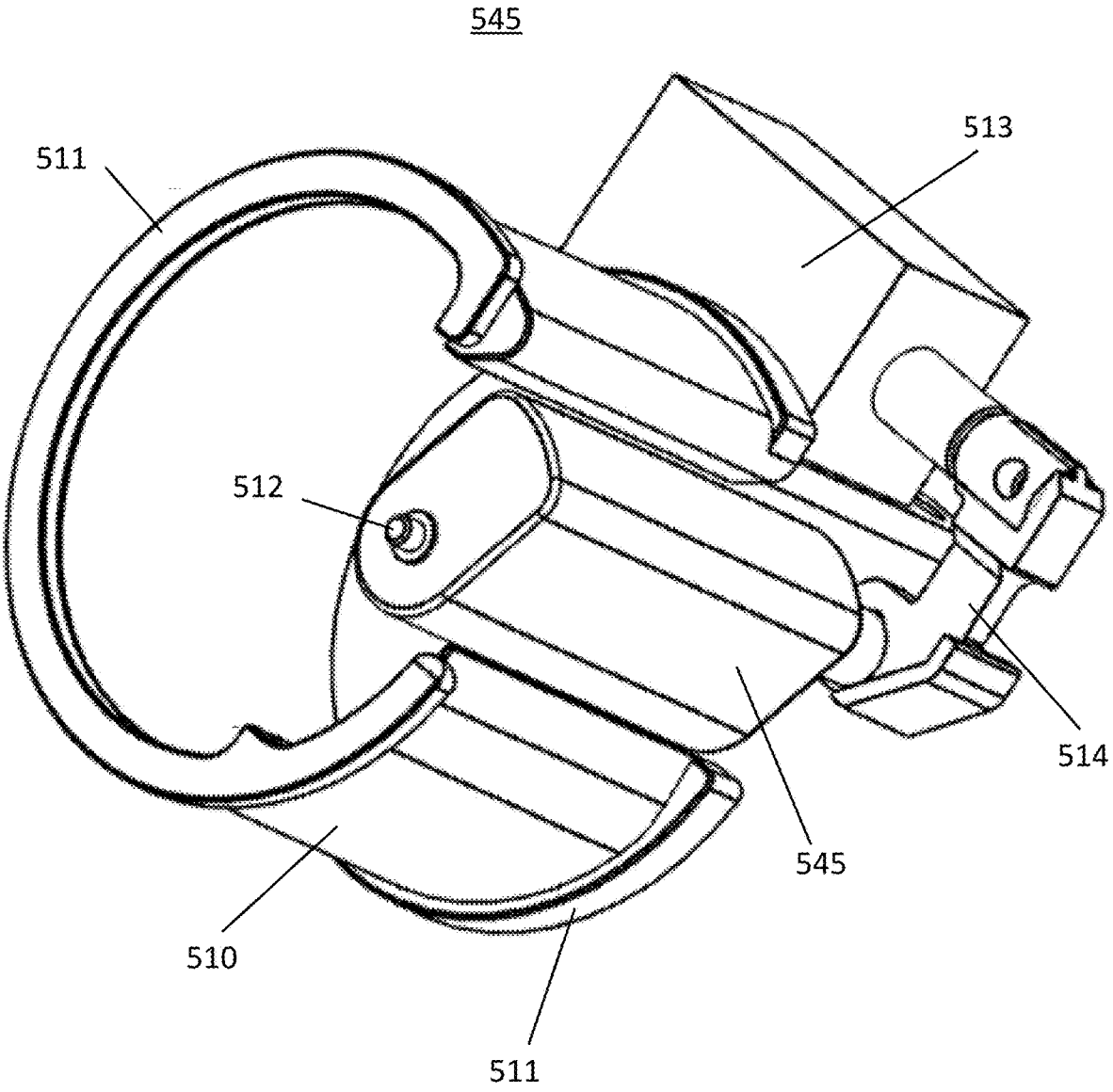
FIG. 5D illustrates a locking mechanism with variable locking states or positions.

FIG. 5D illustrates an isolated view of locking component 545 that is disposed on an inner chamber or aperture of leaf perch 540A. It should be noted that the notches could be positioned at varying degrees anywhere from 45 degrees to the complete 90-degree horizontal ending position. These notches can be in increments of 3, 5, 10 or other non-linear increments. The mechanism of the locking component pawl 545 includes a barrel 510 that frictionally fits within an aperture defined by the leaf perch 540A with force being applied by flexible ring clips 511 on each side of the barrel 510. The pawl 545 is pivotal about hinge 512 for engaging and releasing with notches 542. The locking mechanism pawl 545 can be withdrawn to not engage with notches 542 via actuator 513 which can move connector arm 514 forward and backward to directly control positioning of the pawl 545.

Figure 6A:
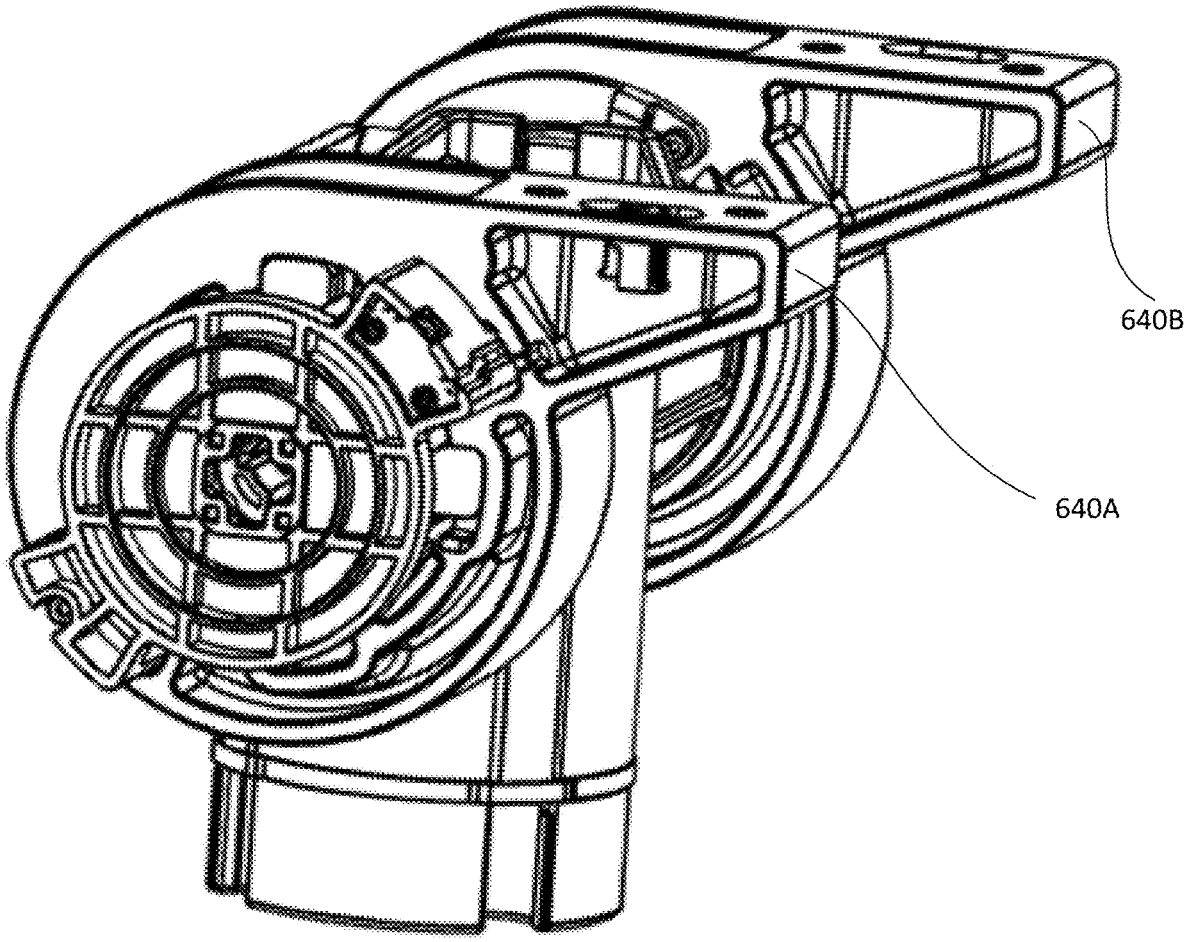
FIG. 6A illustrates another embodiment of a locking mechanism for use with an intelligent automated chair.
Figure 6B:
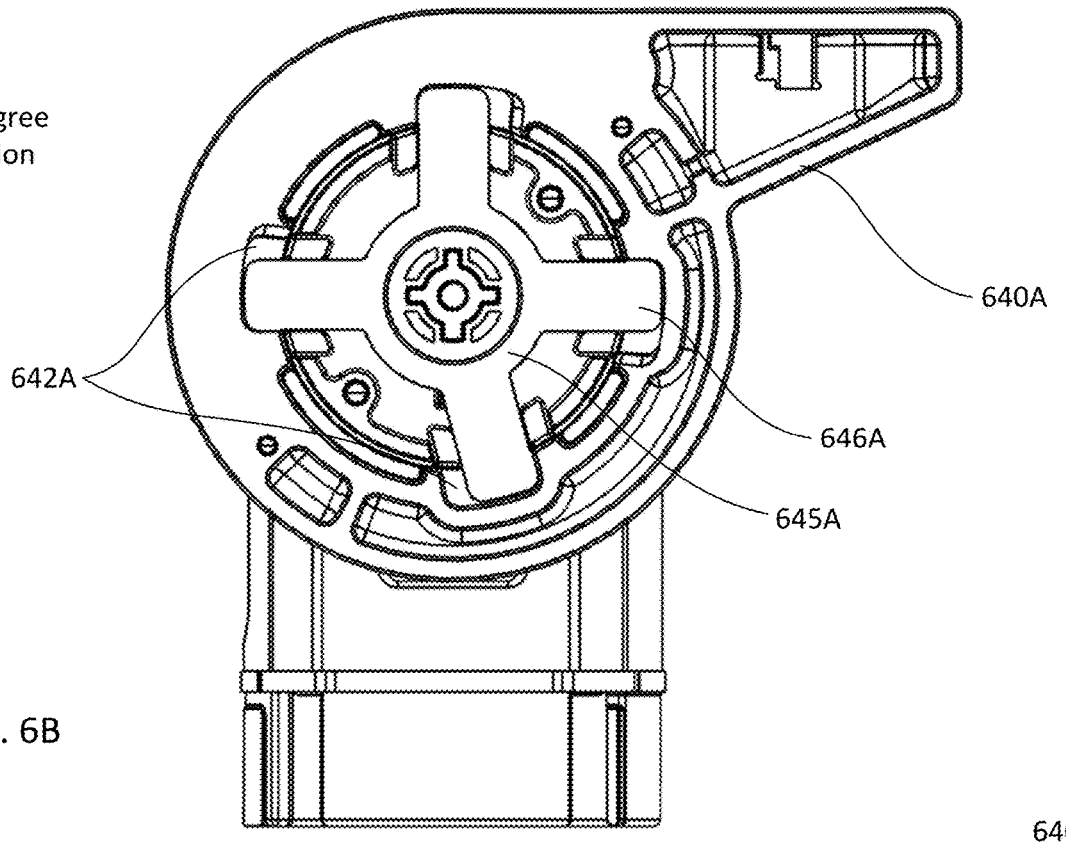
FIG. 6B illustrates another embodiment of a locking mechanism for use with an intelligent automated chair.
Figure 6C:
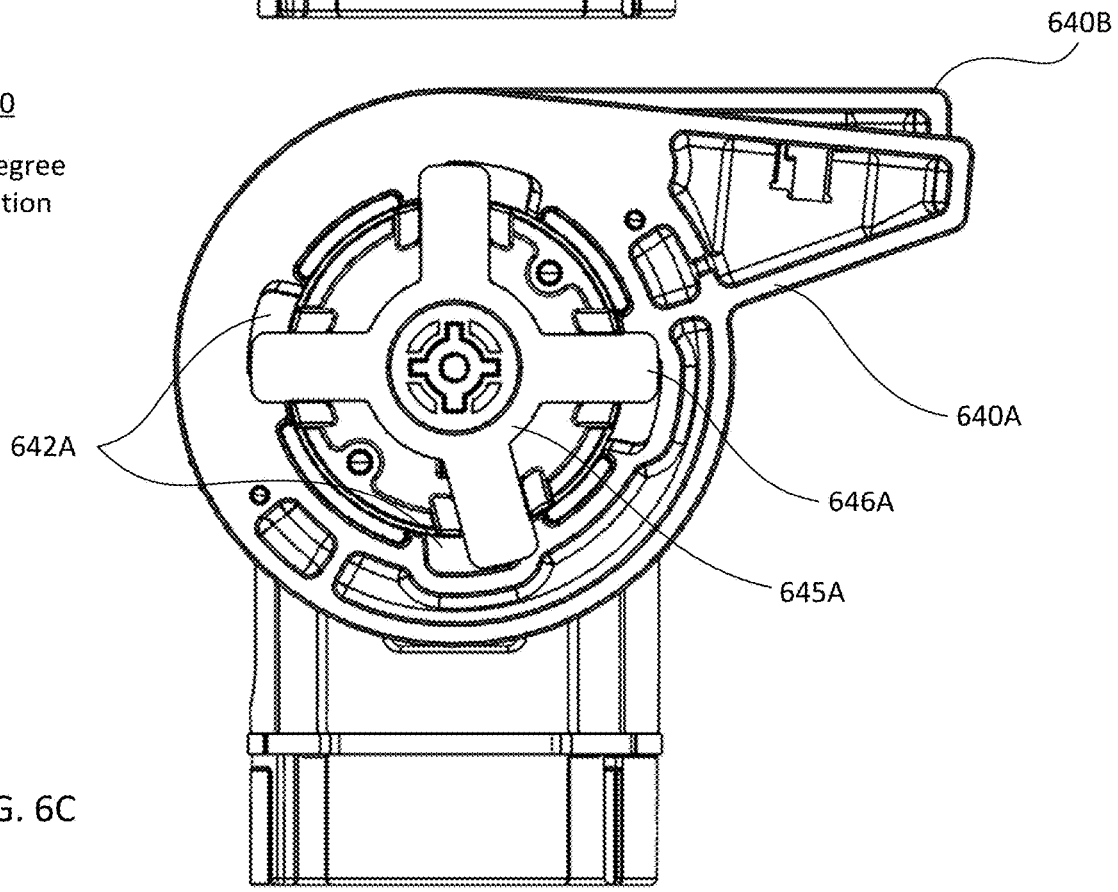
FIG. 6C illustrates another embodiment of a locking mechanism for use with an intelligent automated chair.
Figure 6D:
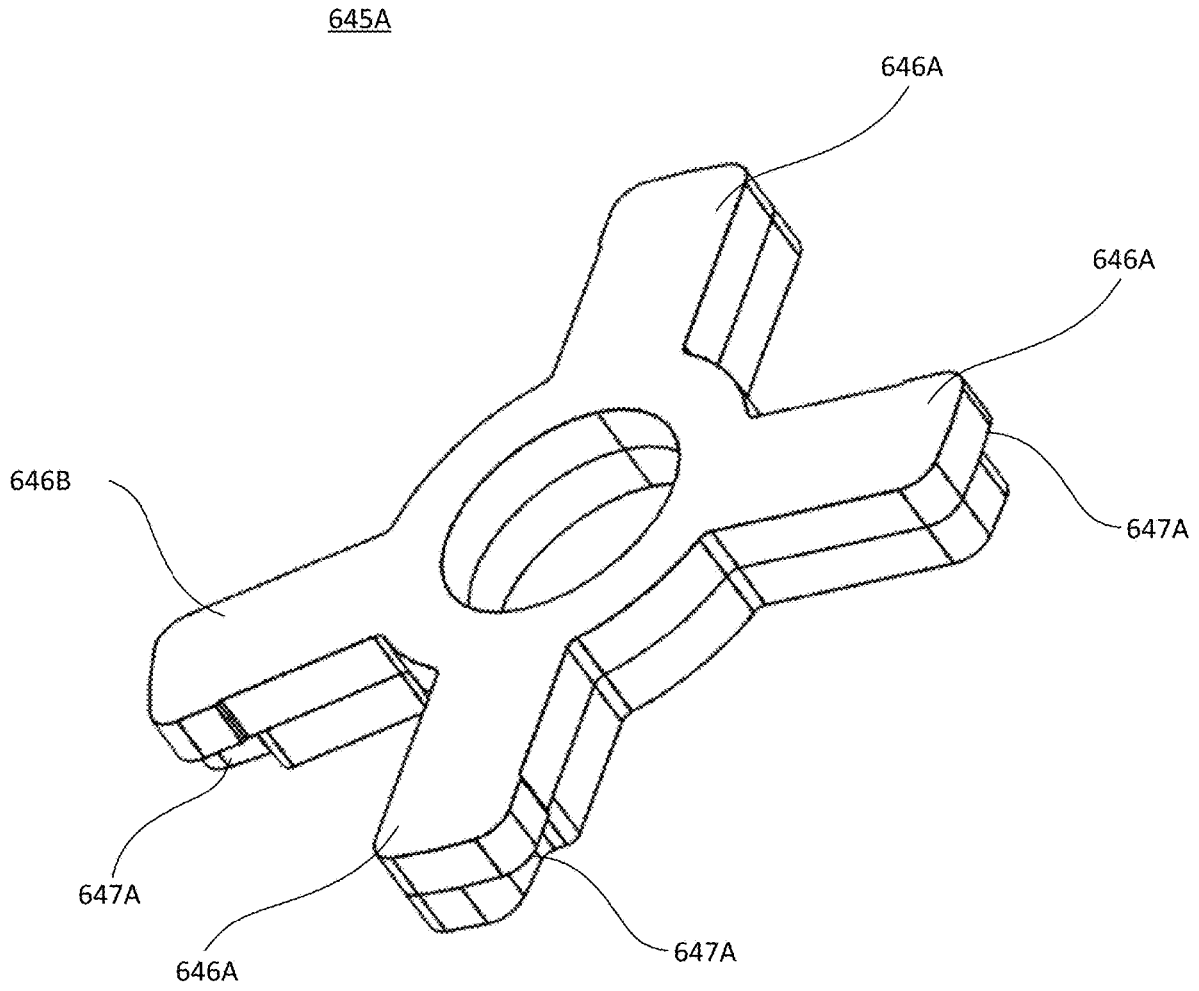
FIG. 6D illustrates another embodiment of a locking mechanism for use with an intelligent automated chair.

FIGS. 6A-D illustrate another embodiment of a locking mechanism for use with an intelligent automated chair. For this embodiment the locking mechanism is configured to have only one locking position off the desired 90-degree horizontal ending position. As shown in the perspective view of FIG. 6A both leaf perches 640A and 640B are positioned at 90-degrees. FIG. 6B illustrates a side view with both leaf perches 640A and 640B positioned at 90-degrees, whereas FIG. 6C illustrates a side view with leaf perch 640A positioned at 85-degrees, where the locking mechanism has engaged. It should be noted that for this example we use 85 degrees as the 'catch' position, but it could any position from 45-degrees up until 90-degrees. Generally, 75 to 85-degrees is in the preferred 'catch' range. For this embodiment, the leaf perch 640A forms a locking mechanism with an offset key locking component 645A shown in this embodiment as a plate with extending arms, and which is shown isolated in FIG. 6D. The offset key locking component shown here has four arms, including three arms 646A that are generally at 90-degree offsets from each other and an offset arm 646B that is angled less than 90-degrees from one of the adjacent arms 646A and greater than 90-degrees from another adjacent arm 646A. The purpose of the offset arm configuration is to allow the locking component 645A to engage with the slots 642A when the seat is in the horizontal position, but to prevent the offset arm 646B, and in turn all of the other arms 646A from engaging slots when the leaf perch 640A is rotated 90 degrees downward in the vertical position. Were the arms all at 90 degrees from each other, they would lock into the slots in both the horizontal position as well as the vertical position, and would require a disengagement structure or system to release from vertical, which adds to the complexity of the device and can create more opportunities for mechanical failure and other operational issues.

Each of the arms 646A, 646B has a notch portion 647A that interfaces with a first portion of a slot 642A once the designated angle such as 85-degrees is reached. As the leaf perch continues to rotate to 90-degrees, the remaining portion of the each of the arms of the offset key locking plate 645A can engage fully with the slot 642A and lock the leaf perch into the final 90-degree position as shown in FIG. 6B versus the 85-degree locked position shown in FIG. 6C. In operation, it has been found that it takes some experience for users to reliably transition properly between positions. One risk is that a user may sit on the seat before it has fully moved to the horizontal position, i.e. when the seat is very close to, but not fully horizontal. In such a case, a user may sit on the seat when it is, for example, 3 degrees off horizontal, which could cause the seat to release in some circumstances. Thus, the locking mechanism of this embodiment includes the 85 degree (or other angle slightly off the 90 degree position) to catch the seat in a locked state in such a condition. This solution creates an interaction that also helps a user. The lock at 85 degrees (or other angle slightly off the 90 degree position) is much more easily achieved right away by everyone. The motor may continue operating to drive the seat to its fully raised and locked 90 degree position. The approximately 85 degree locking notch 647A helps make a reliable early lock, then the chair's seat-moving motor may get the user to the proper horizontal position at 90 degrees or approximately 90 degrees. In other embodiments, the final seated angle may be different from 90 degrees from vertical, for example of 88 degrees, with the locking safety notch 647A 5 degrees off from that at 83 degrees. Of course, other embodiments may also have other angle configurations without straying from the scope of this disclosure. The leaf perch can include four corresponding slots 642A to match up to the four arms of 645A, including having an offset angled slot. The arms of the offset key locking component 645A can either be forced into the slots with a spring that is either pushing or pulling arms 646A, 646B into the slots as the leaf perch rotates. Another pushing or release mechanism such as an actuator, spring release, or the like can force 645A out of the slots when it is time to rotate from horizontal position down to the vertical or almost vertical position during the one-leg or two-leg standing position as noted above. Once advantage of the locking mechanism that is part of the control assembly 600 is that the arms can be more robust and configured to handle more weight or force once engaged.

It should be noted that 645A can be formed of two components initially prior to combining them together as a functioning offset key locking component 645A. They can also be made or formed of a solid unitary material, such as steel.

Figure 7:
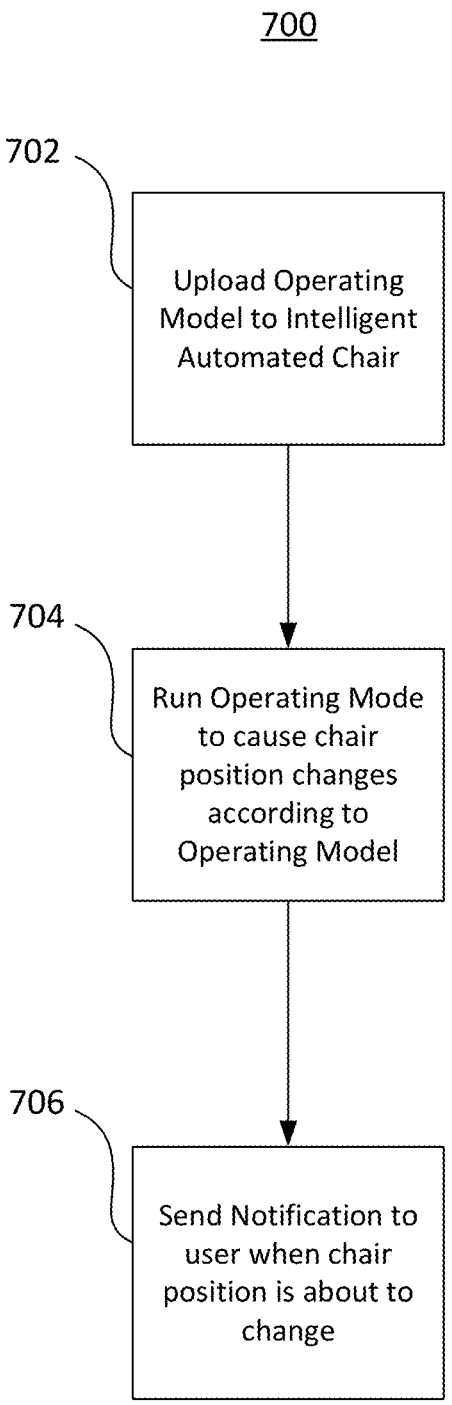
FIG. 7 illustrates a flowchart where the user receives a notification prior to the intelligent automated chair changing positions.

FIG. 7 illustrates a flowchart 700 where the user receives a notification prior to the intelligent automated chair changing positions. The intelligent automated chair is configured to receive or have operating model uploaded to it in step 702. In step 704, the intelligent automated chair begins running the operating model. In step 706, the user receives a notification prior to and when the chair is about to change positions. This notification can come in a variety of formats and is determined by the user. The notifications can include, the right leaf or left leaf vibrating, an audible sound from the intelligent automated chair or smartphone, a light notification from the intelligent automated chair, smartphone or other connected device, or a physical contact by the intelligent automated chair. This physical contact can include the right or left leaf beginning to raise up and engaging the user on the back of the leg indicating that the right or left leaf is about to raise to a horizontal position.

Figure 8:
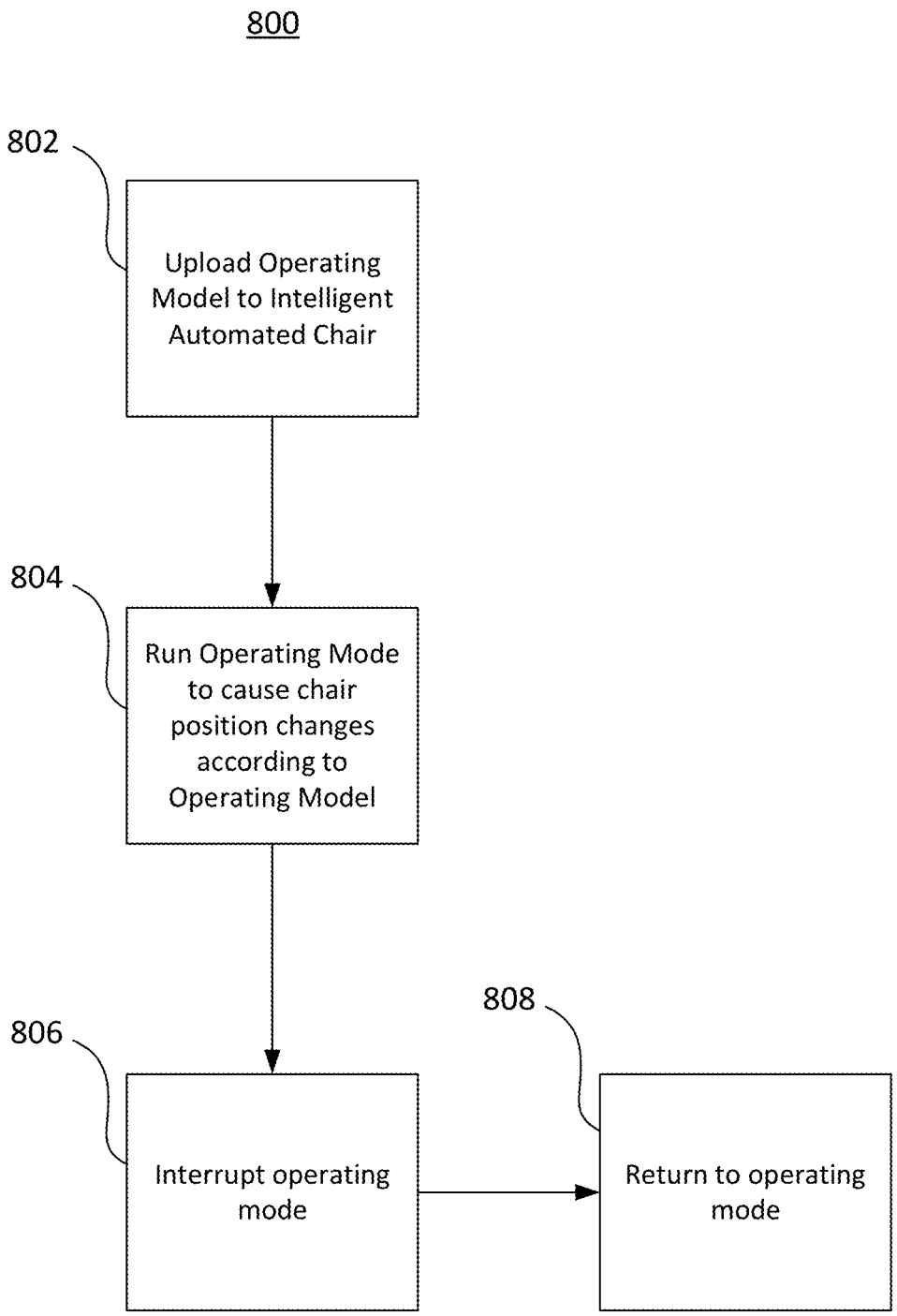
FIG. 8 is a flowchart that illustrates the interruptible nature of the intelligent automated chair.

FIG. 8 is a flowchart 800 that illustrates the interruptible nature of the intelligent automated chair. The intelligent automated chair is configured to receive or have operating model uploaded to it in step 802. In step 804, the intelligent automated chair begins running the operating model. Once the intelligent automated chair begins cycling through the position changes it can be interrupted in step 806 for a period of time. This interruption can be the result of the user manually blocking a change, it can be an automated result of sensor determining the user is blocking the change through a sensed means, or it can be interrupted as a result of a predefined setting that blocks the change whenever a particular event or sensed event occurs. For example, the operating mode could be interrupted when an overhead announcement occurs, a phone call is received, another user is detected nearby, or an event such as a team meeting occurs on the user's calendar. After the interruption, the operating mode can resume its normal operating mode in step 808.

An additional interruption can include where the user slips or sits too early on a particular leaf and the sensor detects that the leaf has not reached the desired 90-degree position. In this situation the chair can provide and indicator, if the user has already realized the final position has not been reached, to release the pressure or weight, where the leaf can continue to raise up to the final end horizontal position.

In one aspect, a locking mechanism for use with an intelligent automated chair is provided. The intelligent automated chair includes: a base portion, a vertical support extending from the base portion, a horizontal support interfacing with the vertical support, a right leaf extending from the horizontal support and configured to be driven by a right motor that causes the right leaf to alter between positions of horizontal and vertical, a left leaf extending from the horizontal support and configured to be driven by a left motor that causes the left leaf to alter between positions of horizontal and vertical. The chair further has an automated control assembly electrically coupled to the right motor and the left motor. The chair is configured to operate according to an automated shifting pattern that causes the right leaf and left leaf to change positions, wherein each position change is associated with a posture change, and wherein the automated control assembly is also configured to receive user input that can modify the automated shifting pattern. The chair further has a seat locking mechanism is comprised of a releasable locking component that is configured to allow a plurality of ridges, each formed within an inner portion of a leaf perch that is attached to the right or left leaf perch, to pass thereby along a first direction of rotation. Upon a force that is counter to the first direction of rotation, the locking mechanism engages with one of the plurality of ridges and prevents rotation that is counter to the first direction of rotation. This embodiment may be similar to the locking mechanism shown in FIGS. 5A-D.

In another aspect, a locking mechanism for use with an intelligent automated chair is provided. The intelligent automated chair includes: a base portion, a vertical support extending from the base portion, a horizontal support interfacing with the vertical support, a right leaf extending from the horizontal support and configured to be driven by a right motor that causes the right leaf to alter between positions of horizontal and vertical, a left leaf extending from the horizontal support and configured to be driven by a left motor that causes the left leaf to alter between positions of horizontal and vertical. The chair further has an automated control assembly electrically coupled to the right motor and the left motor, and is configured to operate according to an automated shifting pattern that causes the right leaf and left leaf to change positions, wherein each position change is associated with a posture change. The automated control assembly is also configured to receive user input that can modify the automated shifting pattern. The locking mechanism of this aspect comprises a releasable locking component comprised of a plurality of arms. Each arm has an offset ledge (also called a "notch") disposed on an underneath portion of each arm, and wherein each offset ledge is configured to initially engage with a plurality of slots, each slot formed within an inner portion of a leaf perch that is attached to the right or left leaf perch. This locking mechanism may further utilize a slot spring configured to force the offset ledge of each arm and then the remaining portion of each arm of into the plurality of slots as the rotation of the leaf perch reaches the first engagement angle and then the second engagement angle. This embodiment may be similar to the locking mechanism shown in FIGS. 6A-D.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention. Additionally, any features, structures, components, method steps which are discussed in reference to any one of the aforementioned embodiments are readily adaptable for use into and with any features of the other alternative embodiments discussed therein, with the understanding that one of ordinary skill in the art will be capable of assessing the ability of the various embodiments disclosed and be capable of making such adaptations.

What is claimed is:

1. A locking system and adjustable chair combination comprising:

a control assembly having a motor, the motor operable to move a seat of an adjustable chair between a horizontal seated position and a vertical standing position; and a locking mechanism having a slot that can interface with a portion of the control assembly or the seat to stop a movement of the seat towards the vertical standing position, the locking mechanism configured to stop the movement of the seat when the seat is in a position between the horizontal seated position and vertical standing position;

wherein the locking mechanism comprises a releasable locking component configured to permit rotation of the seat in a first direction while engaging with the slot to prevent rotation in a second, opposite direction in response to a force applied to the seat.

2. The locking system and adjustable chair combination of claim 1 wherein a front of the seat is pointed downwardly towards the floor in the vertical standing position.

3. The locking system and adjustable chair combination of claim 1 wherein the seat of the adjustable chair comprises a first leaf and a second leaf, the first leaf and second leaf movable independently of each other and each movable between the horizontal seated position and vertical standing position, wherein the locking mechanism is engaged with the first leaf, and further comprising a second locking mechanism having a slot that can interface with a portion of the control assembly or second leaf to stop a movement of the second leaf towards the vertical standing position, the locking mechanism configured to stop the movement of the second leaf when the second leaf is in a position between the horizontal seated position and vertical standing position.

4. The locking system and adjustable chair combination of claim 1 wherein the locking mechanism comprises a plurality of slots, each slot able to interface with a portion of the control assembly or seat to stop a movement of the seat towards the vertical standing position.

5. The locking system and adjustable chair combination of claim 1 wherein the locking mechanism is releasable from a locking mode to allow free movement of the seat by the motor.

6. The locking system and adjustable chair combination of claim 1 further comprising a gearbox connected to the motor.

7. The locking system and adjustable chair combination of claim 1 further comprising a leaf perch connecting the motor and the seat, the leaf perch movable by the motor.

8. The locking system and adjustable chair combination of claim 6 further comprising a leaf perch connecting the motor and the seat, the leaf perch connected movable by the motor by way of the gearbox.

9. A locking system and adjustable chair combination comprising:

a control assembly having a motor, the motor operable to move a seat of an adjustable chair between a horizontal seated position and a vertical standing position; and a locking mechanism having a slot that can interface with a portion of the control assembly or the seat to stop a movement of the seat towards the vertical standing position, the locking mechanism configured to stop the movement of the seat when the seat is in a position between the horizontal seated position and vertical standing position;

wherein the locking mechanism comprises the slot formed as a notch formed on an inner surface of a leaf perch connected to the seat, a pawl engageable and disengageable with the notch, wherein an engagement of the pawl with the notch prevents a movement of the seat to the vertical standing position.

10. The locking system and adjustable chair combination of claim 9 further comprising a plurality of notches and a single pawl.

11. The locking system and adjustable chair combination of claim 9 further comprising a release operable to draw the pawl out of the notch.

12. The locking system and adjustable chair combination of claim 9 wherein the pawl is attached to a barrel which is connected to the leaf perch, and an actuator engaged with the pawl to disengage the pawl from the notch.

13. The locking system and adjustable chair combination of claim 12 wherein the actuator is connected to a connector arm, and the connector arm is connected to the pawl, the actuator operable to move the connector arm forward and backward to control a position of the pawl.

14. A locking system and adjustable chair combination comprising:

a control assembly having a motor, the motor operable to move a seat of an adjustable chair between a horizontal seated position and a vertical standing position; and a locking mechanism having a slot that can interface with a portion of the control assembly or the seat to stop a movement of the seat towards the vertical standing position, the locking mechanism configured to stop the movement of the seat when the seat is in a position between the horizontal seated position and vertical standing position;

wherein the seat comprises a leaf perch and defines a plurality of slots, the locking mechanism comprising a plurality of arms, the plurality of slots having one slot for each of the plurality of arms, the plurality of arms being engageable with the plurality of slots and being urged into the plurality of slots.

15. The locking system and adjustable chair combination of claim 14 wherein each of the plurality of arms comprises a notch at a bottom surface facing the leaf perch, the notch offset slightly from a lengthwise edge of a top of the leaf perch such that upon a rotation of the leaf perch to a first engagement angle relative to the locking mechanism, the notch will engage with the slot, and such that upon a rotation of the leaf perch to a second engagement angle, the entire arm engages with the slot.

16. The locking system and adjustable chair combination of claim 15 wherein each notch of the plurality of arms engages with the plurality of slots when the seat is in a position slightly downward form horizontal, and wherein the entire of the plurality of arms engages with the plurality of slots when the seat is in the horizontal seated position.

17. The locking system and adjustable chair combination of claim 16 wherein the plurality of notches engages with the plurality of slots at an 85-degree angle.

18. The locking system and adjustable chair combination of claim 14 wherein a first of the plurality of arms has a first angle relative to an adjacent of the plurality of arms that is different from a second angle relative to a second adjacent of the plurality of arms, and wherein the plurality of slots has a first of the plurality of slots with a same orientation as the first of the plurality of arms.

19. The locking system and adjustable chair combination of claim 18 wherein the plurality of arms are at 90 degree angle relative to each other, except the first of the plurality of arms which is at a greater than 90 degree angle relative to the first adjacent of the plurality of arms, and at a less than 90 degree angle relative to the second adjacent of the plurality of arms.

20. The locking system and adjustable chair combination of claim 14 wherein a spring urges the plurality of arms towards the plurality of slots.

* * * * *